United States Patent [19]

Caravello

[11] 4,240,449

[45] Dec. 23, 1980

[54] CIGARETTE AND CIGAR EXTINGUISHER

[76] Inventor: John C. Caravello, P.O. Box 141, Norwich, N.Y. 13815

[21] Appl. No.: 68,386

[22] Filed: Aug. 21, 1979

[51] Int. Cl.[3] ..... A24F 13/18

[52] U.S. Cl. ..... 131/235 ST; 131/256

[58] Field of Search ..... 131/235, 235 ST, 256; 46/25, 26; 35/22 A

[56] References Cited

U.S. PATENT DOCUMENTS

| | | | |
|---|---|---|---|
| Re. 29,001 | 10/1976 | Foote | 131/235 ST |
| 1,372,124 | 3/1921 | Downey | 131/235 R |
| 2,509,669 | 5/1950 | Borst | 46/26 UX |
| 2,764,165 | 9/1956 | Lincecum | 131/235 R |
| 3,013,566 | 12/1961 | Collins | 131/235 ST |
| 3,775,868 | 12/1973 | Moore | 35/22 A |

*Primary Examiner*—Stephen C. Pellegrino

*Attorney, Agent, or Firm*—Shoemaker and Mattare

[57] ABSTRACT

A cigarette and cigar extinguisher includes a base with a snuffer releasably mounted in a receptacle defined in the base. Both the receptacle and the body of the snuffer are polygonally shaped, and the snuffer includes a pair of sections. Removal of the snuffer from the receptacle and separation of the snuffer sections permits easy cleaning of the snuffer.

10 Claims, 6 Drawing Figures

CIGARETTE AND CIGAR EXTINGUISHER

BACKGROUND OF THE INVENTION

The present invention relates in general to cigar and cigarette extinguishers, and, more particularly, to such devices which are easily and effectively cleaned and manufactured.

There are many devices presently available in which cigars and cigarettes are extinguished and discarded. Examples of such devices are found in U.S. Pat. Nos. 1,764,862, 3,782,394, 3,431,916, 2,586,466, and 2,406,685, as well as others.

However, none of these devices are easily cleaned or manufactured. Often, special picks and brushes must be used to remove broken or very short butts. Furthermore, complete cleaning of all surfaces of such devices cannot be easily effected, thereby causing such devices to be foul smelling, and perhaps even rendering these devices useless after a period of use.

Furthermore, these devices are not easily and inexpensively manufacturable, thereby raising the cost thereof to the consumer.

Accordingly, there is need for a device which can be easily, yet thoroughly, cleaned, and one which can be manufactured in an inexpensive manner.

SUMMARY OF THE INVENTION

The device embodying the teachings of the present invention is easily cleaned and can be manufactured inexpensively.

The device includes a bipartite snuffer which includes a pair of identical sections. Each section has a key and a key receiving hole defined therein. The key of one section, by rotating either section 180° face-to-face, will produce a key to hole alignment and is received in the key receiving hole of the other section.

One half of a stepped snuffer bore is defined in each section to define a single blind-ended bore when the snuffer is assembled.

The snuffer is supported in a multi-compartment ashtray in one embodiment, and in a jacket in another embodiment. In each embodiment, the snuffer body is polygonal and is accommodated in a correspondingly shaped and sized polygonal snuffer receptacle, or keeper. The receptacle and the snuffer body have edges which abut to constrain the snuffer against twisting and lateral movement about the longitudinal centerline thereof when a cigar or cigarette is being snuffed.

All parts of the device are easily cleaned because all parts of the snuffer which contact a cigar or cigarette are exposed when the snuffer sections are separated. This is especially true of the stepped bore.

Because of the polygonal shape of the snuffer, it is easily removed from the keeper to permit removal of broken or very short butts without requiring use of picks or brushes.

The snuffer of the instant disclosure can be inexpensively produced and can be formed of metals, ceramics, refractories, high temperature fire resistant plastics, or the like.

OBJECTS OF THE INVENTION

It is, therefore, a main object of the present invention to provide a cigar and/or cigarette snuffer which is easily cleaned.

It is another object of the present invention to provide a cigar and/or cigarette snuffer which is easily manufactured.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
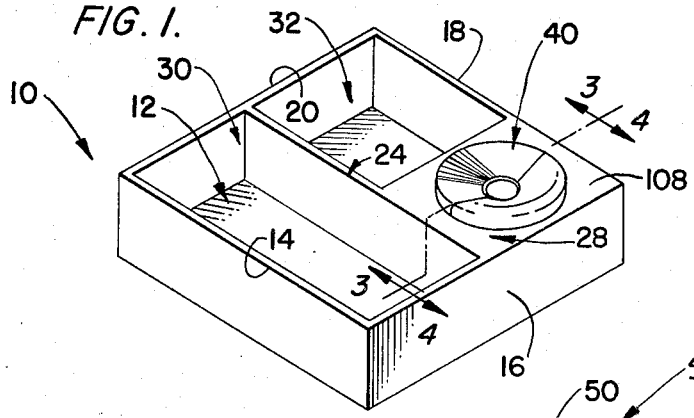
FIG. 1 is a perspective view of a multi-compartment ashtray having a snuffer embodying the teachings of the present invention mounted therein.

Shown in FIG. 1 is a multi-compartment ashtray 10 having a base 12 with side walls 14, 16, 18 and 20 extending upwardly therefrom. A partition 24 is in spaced parallelism with side walls 14 and 18 and divides the ashtray into a plurality of compartments. A snuffer section 28 is located interjacent walls 16 and 18 and the partition 24. Compartments 30 and 32 are defined in the ashtray to serve as receptacles for ashes, waste and other such debris.

Figure 2:
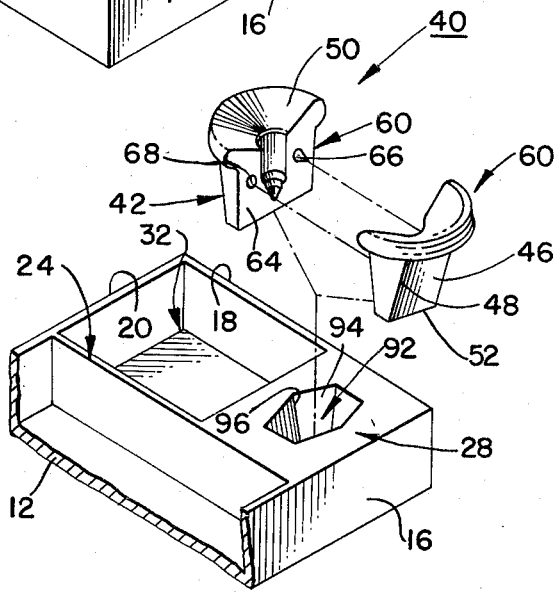
FIG. 2 is an exploded perspective of a portion of the device shown in FIG. 1.

A snuffer 40 is releasably and removably mounted in the snuffer section 28, and is best shown in FIG. 2. The snuffer 40 has an elongated hexagonal body 42 which includes a plurality of planar surfaces, such as surface 46, with adjacent surfaces intersecting to form ribs 48. The body 42 includes a dish-shaped apron section 50 on one end thereof and a hexagonal base 52 on the other end thereof.

For the sake of convenience, the dish-shaped apron section 50 will be taken as the top of the snuffer and the base 52 will be taken as the bottom of the snuffer. This nomenclature is used for convenience only and is not intended to be limiting.

Figure 3:
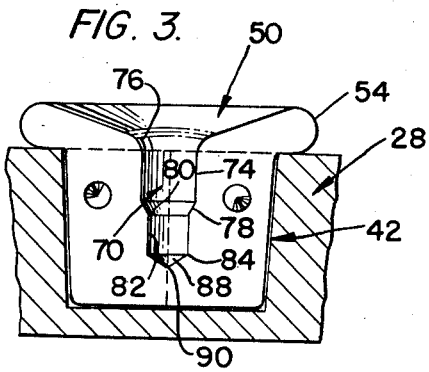
FIG. 3 is a view taken along line 3—3 of FIG. 1.
Figure 4:
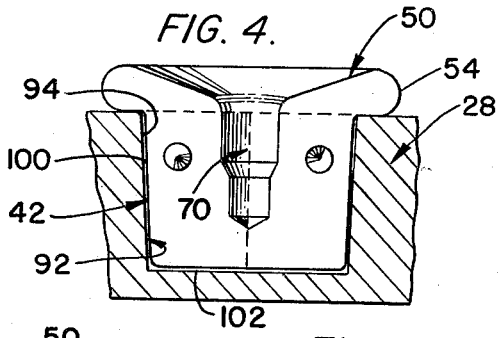
FIG. 4 is a view taken along line 4—4 of FIG. 1.
Figure 5:
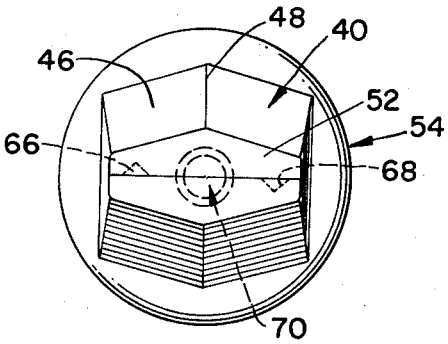
FIG. 5 is a bottom view of the snuffer embodying the teachings of the present invention.

The body section 42 is downwardly and inwardly tapered as indicated in the Figures in one embodiment. As best shown in FIGS. 2-4, the dish-shaped apron is upwardly concave and has an arcuate rib 54 defining the outer peripheral edge thereof. The apron thickens radially outward and is sloped radially inward toward the center thereof.

As best shown in FIG. 2, the snuffer is bipartite and includes a pair of sections 60. Each section is identical with the other section and comprises one half of the snuffer and includes a face 64 having a key 66 and a key receiving hole 68 defined thereon.

A stepped bore 70 is defined in the snuffer to be coaxial with the longitudinal centerline of that snuffer. The stepped bore is best shown in FIGS. 3 and 4 to include a first entry section 74 having one end thereof connected to an entranceway or lead-in area 76 which smoothly connects that one end to the dish-shaped apron. The entry section is cylindrical or tubular and has the lower end thereof connected to the top end of a downwardly converging section 78. The converging section 78 has the lower end thereof connected to top end 80 of a second or lower cylindrical section 82 which extends downwardly from the top end 80 thereof. The lower tubular section 82 has a bottom end 84 connected to the base of a conical section 88 which has an apex 90 located on the lowermost terminal end of the stepped bore 70 and is remote from the apron section 50.

As is shown in FIG. 2, half of the bore is located in one section of the snuffer and the other half is like the first half and is defined in the other half of the snuffer. The bore is thus divided along the longitudinal centerline thereof.

The stepped nature of the bore permits snuffing of cigarettes and cigars, and the like, effectively without defining a depression to trap ashes. The bipartite nature of the snuffer facilitates expeditious cleaning thereof.

As best shown in FIG. 2, the snuffer support section 28 has a snuffer keeper or receptacle 92 defined therein. The receptacle 92 is shaped to correspond to the shape of the body section 42 of the snuffer and thus is polygonally shaped and includes a plurality of planar sections 94 which intersect at the longitudinal edges thereof to define ribs 96. The planar surfaces and the ribs are sized and positioned to correspond and bear the weight of the body sections of the snuffer 60. As indicated in FIG. 2, the receptacle 92 is inwardly and downwardly sloped in a manner corresponding to the downward convergence of the body 42.

The correspondence between the polygonal shapes of the snuffer body and the receptacle produces a twisting restraining action on the snuffer. That is, contact between the body ribs 48 and the receptacle ribs 96 prevents twisting and lateral movement of the snuffer about the longitudinal centerline thereof. The snuffer is thus securely held in place in the receptacle during snuffing action wherein a cigar or cigarette is placed in the stepped bore, ash first, to snuff that cigar or cigarette. The snuffed cigar or cigarette can be discarded in one of the compartments 30 or 32 of the ashtray 10.

As shown in FIGS. 3 and 4, the receptacle is slightly larger in transverse and longitudinal dimensions than the body 42, and thus side gaps 100 and bottom gap 102 are defined between the snuffer body and the receptacle inner surfaces when the snuffer 40 is supported by planar surfaces 46 of the body 60 resting on the uppermost portion of planar surface 94 of the snuffer support section 28.

Easy and expeditious cleaning of the snuffer is effected by merely withdrawing that element from the receptacle and opening it up over a suitable ash collecting means. The stepped nature of the bore 70 prevents any accumulation of ashes in the bore during cleaning, and thus further facilitates cleaning thereof. Cleaning is easy because all surfaces which come in contact with the cigar or cigarette are exposed when the snuffer sections are separated.

Figure 6:
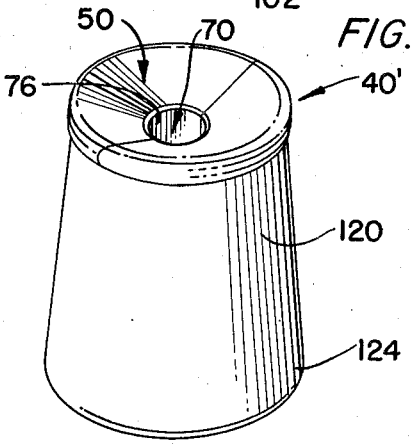
FIG. 6 is a perspective view of an alternative embodiment of the snuffer embodying the teachings of the present invention.

An alternative embodiment of the snuffer is shown in FIG. 6 and is indicated by the reference numeral 40'. The snuffer 40' includes a jacket 120 which is frustoconically shaped and is upwardly convergent. The body of the snuffer 40' can be upwardly convergent as opposed to the downward convergence of the snuffer body 42, or can be downwardly convergent as well, as suitable. In either case, a receptacle is defined in the jacket 120 to accommodate the snuffer in a manner identical to the twisting preventing, demountable nature of the accommodation of snuffer 40 in the receptacle 92 as shown in FIG. 2.

The snuffer 40' is also bipartite and it is otherwise similar to the snuffer 40, and thus will not be further described. Thus, a stepped bore 70 is defined in the snuffer 40' and has an entranceway, or lead-in area 76 defined in dish-shaped apron section 50 which has the lower body planar surface 46 thereof resting on the planar surfaces 94 of the jacket 120 to support the snuffer therein.

The jacket 120 has a base section 124 and the downward divergence of that jacket produces a stable structure which reliably remains in the FIG. 6 orientation during any snuffing action. The large base of the jacket also lowers the center of gravity of the entire device so that the device is not likely to tip over during such snuffing action.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. An extinguisher for cigars and/or cigarettes comprising:

a base having a polygonal receptacle defined therein;

a snuffer for receiving cigars or cigarettes releasably mounted in said polygonal receptacle, said snuffer including a pair of sections separably connected together, each section having a body portion in the shape of an elongated semi-polygon, a semi-circular apron portion on one end of said body portion and a portion of a stepped blind-ended bore defined in said body portion to have one end thereof contacting said apron portion and extending away from said apron portion;

said snuffer portions each having locking means and a lock receiving means thereon, said snuffer body forming a polygonal shape corresponding to the polygonal shape of said receptacle, said apron portions forming a circular apron, and said bore portions forming a stepped, blind-ended bore when said snuffer portions are mated together;

said snuffer being accommodated in said receptacle with edges of said polygonal shapes corresponding so that said snuffer is held in said receptacle in a manner which inhibits twisting and lateral movement of said snuffer about a longitudinal axis thereof.

2. The extinguisher defined in claim 1 wherein said polygonal shapes are hexagons.

3. The extinguisher defined in claim 1 wherein said locking means include keys.

4. The extinguisher defined in claim 1 wherein said base includes a multi-compartment ashtray.

5. The extinguisher defined in claim 1 wherein said base includes a jacket surrounding said snuffer.

6. The extinguisher defined in claim 1 wherein said receptacle is slightly larger than said snuffer allowing only planar surfaces to meet.

7. The extinguisher defined in claim 1 wherein said snuffer body is elongate and tapers inwardly from said apron portions and said receptacle tapers inwardly.

8. The extinguisher defined in claim 1 wherein said stepped bore includes a first entranceway defined in said apron near the center thereof, a first cylindrical section connected at one end to said entranceway, a converging section connected at one end to another end of said first cylindrical section, a second cylindrical section connected at one end to another end of said converging section, and a conical section connected at a base section thereof to another end of said second cylindrical section and having an apex disposed remotely from said apron.

9. The extinguisher defined in claim 1 wherein said apron is upwardly concave in shape.

10. The extinguisher defined in claim 9 wherein said section includes a planar surface of said snuffer resting on a planar surface of said base.

* * * * *